United States Patent [19]

Oda et al.

[11] 4,297,182

[45] Oct. 27, 1981

[54] PRODUCTION OF ALKALI METAL HYDROXIDE

[75] Inventors: Yoshio Oda; Takeshi Morimoto; Kohji Suzuki, all of Yokohama, Japan

[73] Assignee: Asahi Glass Company, Ltd., Tokyo, Japan

[21] Appl. No.: 141,401

[22] Filed: Apr. 18, 1980

[30] Foreign Application Priority Data

May 4, 1979 [JP] Japan ..... 54-54040

[51] Int. Cl.[3] ..... C25B 1/34; C25B 11/03; C25B 11/06; C25B 13/08

[52] U.S. Cl. ..... 204/98; 204/128; 204/283; 204/291; 204/292

[58] Field of Search ..... 204/128, 98, 283, 292, 204/291, 282

[56] References Cited

U.S. PATENT DOCUMENTS

| | | | |
|---|---|---|---|
| 4,116,804 | 9/1978 | Needes | 204/290 R |
| 4,118,294 | 10/1978 | Pellegri | 204/291 |
| 4,170,536 | 10/1979 | Kawasaki et al. | 204/290 R |
| 4,191,618 | 3/1980 | Coker et al. | 204/283 |
| 4,209,368 | 6/1980 | Coker et al. | 204/283 |
| 4,210,501 | 7/1980 | Dempsey et al. | 204/283 |
| 4,224,121 | 9/1980 | Dempsey et al. | 204/283 |

FOREIGN PATENT DOCUMENTS

| | | | |
|---|---|---|---|
| 5528216 | 8/1978 | Japan | 204/291 |
| 2009795 | 6/1979 | United Kingdom | 204/98 |

*Primary Examiner*—R. L. Andrews

*Attorney, Agent, or Firm*—Oblon, Fisher, Spivak, McClelland & Maier

[57] ABSTRACT

A gas and liquid permeable cathode is bonded on an ion-exchange membrane and the composite electrode is used in an electrolytic cell for a production of sodium hydroxide by an electrolysis of an aqueous solution of sodium chloride. The cathode comprises a thermally decomposed nickel obtained from a nickel salt of fatty acid, Raney nickel, stabilized Raney nickel or carbonyl nickel and a polytetrafluoroethylene.

7 Claims, No Drawings

PRODUCTION OF ALKALI METAL HYDROXIDE

BACKGROUND OF THE INVENTION

1. Field of the Invention

The present invention relates to a process for producing an alkali metal hydroxide. More particularly, it relates to a process for producing an alkali metal hydroxide by electrolyzing an alkali metal chloride at low cell voltage by a diaphragm method using a cation exchange membrane.

2. Description of the Prior Arts

It has been proposed to produce an alkali metal hydroxide by electrolyzing an aqueous solution of an alkali metal chloride by a diaphragm method wherein an ion-exchange membrane is used instead of using asbestos as a diaphragm so as to obtain an alkali metal hydroxide having high purity and high concentration.

On the other hand, it has been proposed to save energy in the world. From the viewpoint, it has been required to minimize a cell voltage in such technology.

Various methods have been proposed to decrease a cell voltage. It has been proposed to use an electrolytic cell equipped with a gas and liquid permeable anode or cathode bonded on a surface of a fluorinated cation exchange membrane as U.S. Ser. No. 724,968.

In order to minimize an electric resistance caused by an electrolyte or an electric resistance caused by bubbles of hydrogen or chlorine (which have been considered to be difficult for eliminating them), such system is effective as a system for electrolyzing it at lower cell voltage than that of the conventional system.

The anode or the cathode is brought into contact with an ion-exchange membrane in the system. Therefore, the electrode is gas-permeable so as to easily remove the gas formed by the electrolysis from the electrode. That is, the electrode is made of a porous substrate (layer).

The inventors have proposed to produce an alkali metal hydroxide by an electrolysis of an alkali metal chloride at a low voltage by selecting an average pore size and a porosity of the cathode in each desired range. That is, the inventors have found that an alkali metal hydroxide is obtained by an electrolysis of an aqueous solution of an alkali metal chloride at a cell voltage 0.2 to 0.5 V lower than that of the conventional process in stable by using a porous cathode having an average pore size of 0.01 to 1,000$\mu$ preferably 0.1 to 500$\mu$ and a porosity of 20 to 95% preferably 25 to 90% bonded on a surface of a cation exchange membrane.

Various substrates and methods can be considered for preparing such cathode having said properties. According to the inventors experiments, it has been found that the porous cathode having said desired properties can be easily obtained without any special manner.

SUMMARY OF THE INVENTION

It is an object of the present invention to provide a process for producing an alkali metal hydroxide at a low cell voltage in a diaphragm method.

It is another object of the present invention to provide a process for producing an alkali metal hydroxide by using a gas and liquid-permeable cathode or anode bonded on a surface of a fluorinated ion-exchange membrane at a low cell voltage.

The foregoing and other objects of the present invention have been attained by producing an alkali metal hydroxide by using a gas and liquid-permeable cathode bonded on an ion-exchange membrane wherein said gas and liquid-permeable cathode comprises at least one of nickel containing powder selected from the group consisting of a thermally decomposed nickel obtained from a nickel salt of fatty acid; Raney nickel; stabilized Raney nickel; and carbonyl nickel and a polytetrafluoroethylene.

DETAILED DESCRIPTION OF THE PREFERRED EMBODIMENTS

The gas and liquid-permeable cathode is formed by a polytetrafluoroethylene and at least one nickel containing powder selected from the group consisting of a thermally decomposed nickel obtained from a nickel salt of fatty acid; Raney nickel; stabilized Raney nickel and carbonyl nickel.

Suitable nickel salts of fatty acid used in the process of the present invention include nickel formate, nickel acetate, nickel oxalate, nickel stearate and nickel citrate. For example, the nickel salt of fatty acid is thermally decomposed in an inert gas atmosphere at a temperature about 20° C. higher than the thermal decomposition point of the nickel salt for about 20 minutes.

The stabilized Raney nickel is obtained by dissolving an aluminum component of Raney nickel alloy with a base and washing well with water and partially oxidizing it.

The nickel, Raney nickel or carbonyl nickel is used in a powdery form to prepare the cathode.

The property of the powder used as said raw material is slightly different depending upon the kind of the nickel used in the preparation and preferably has an average particle diameter of about 0.01 to 500$\mu$, preferably about 0.01 to 300$\mu$.

When the average particle diameter is smaller than said range, the gas formed by the electrolysis is not easily removed whereas when it is larger than said range, a function as the electrode is inferior to be disadvantageous.

The polytetrafluoroethylene used in the preparation is suitable to be an aqueous dispersion having a particle diameter of less than 1$\mu$.

A ratio of the nickel powder to the polytetrafluoroethylene is usually 10 wt. parts of the nickel powder to 0.05 to 5 wt. parts of the polytetrafluoroethylene. When the ratio is out of said range, an electrode potential is lower the nickel powder is fallen to be higher cell voltage. These are disadvantages.

When 10 wt. parts of the nickel power and 0.1 to 3 wt. parts of the polytetrafluoroethylene are combined, the electrode potential is low enough and the nickel powder is firmly bonded on the cation exchange membrane. These are especially advantageous.

In a practical process for preparing a porous cathode from these raw materials, an aqueous dispersion of polytetrafluoroethylene is admixed with the nickel powder and the mixture is stirred and forming a cake for the cathode on a filter by a filtering method or the mixture is printed on a membrane by a screen printing method. The resulting cathode is brought into contact with the cation exchange membrane. The method of contacting the cathode with the membrane can be a heat press-bonding of the cathode on the cation exchange membrane by using a press-molding machine. A thickness of the cathode layer after bonding is preferably in a range of 0.1 to 500$\mu$ especially 1 to 300$\mu$.

On the other hand, the anode is usually made of platinum group metal such as platinum, iridium, palladium and ruthenium or an alloy thereof; an oxide of the metal or alloy or graphite.

When the anode is used by bonding on the surface of the cation exchange membrane, as that of the cathode, it is preferably used as a porous anode having substantially the same property as that of the cathode. A porous substrate fabricated by using a powder of said material; a gauze; plied gauzes; or a sheet having many through-holes can be used as the anode. The combination of said substance with the other substance can be considered, for example, said substance can be coated on a surface of a porous substrate made of titanium or tantalum. When a platinum group metal or its alloy or an oxide of said metal or alloy is used as the substance for the anode, a cell voltage is especially lower in the electrolysis of an alkali metal chloride. This is especially advantageous.

It is preferable to bond the anode on the cation exchange membrane as that of the cathode because the alkali metal hydroxide can be produced at a minimized cell voltage. Thus, it is possible to place the anode with a desired gap from the cation exchange membrane as the conventional process in the electrolysis. The substance and the structure of the anode can be the same as those of the conventional anode in the latter.

The cathode used in the present invention can be prepared with the above-mentioned components if desired together with the other components such as a pore forming agent, a catalyst etc. as far as the desired object is attained without a trouble.

The cation exchange membrane used in the present invention can be made of a polymer having cation-exchange groups such as carboxylic acid group, sulfonic acid group, phosphoric acid group and phenolic hydroxy group. Suitable polymers include copolymers of a vinyl monomer such as tetrafluoroethylene and chlorotrifluoroethylene; and a perfluorovinyl monomer having an ion-exchange group such as sulfonic acid group, carboxylic acid group and phosphoric acid group or a reactive group which can be converted into the ion-exchange group. It is also possible to use a membrane of a polymer of trifluoroethylene in which ion-exchange groups such as sulfonic acid group are introduced.

It is especially preferable to use monomers for forming the following units (a) and (b) in the copolymer.

$$\left(CF_2-CXX'\right) \quad \text{(a)}$$

$$\left(CF_2-\underset{\underset{Y}{|}}{C}X\right) \quad \text{(b)}$$

wherein X represents fluorine, chlorine or hydrogen atom or $-CF_3$; X' represents X or $CF_3(CF_2)_m$; m represents an integer of 1 to 5 and Y represents —A, —ϕ—A, —p—A or —O—$(CF_2)_n$(P, Q, R)—A; P represents $\left(CF_2\right)_a\left(CXX'\right)_b\left(CF_2\right)_c$; Q represents $\left(CF_2-O-CXX'\right)_d$, and R represents $\left(CXX'-O-CF_2\right)_e$, (P, Q, R) represents at least one of P, Q and R arranged in a desired order; ϕ represents phenylene group; X and X' are defined above; n is 0 to 1 and a, b, c, d and e are respectively 0 to 6; A represents $-SO_3M$, —COOM, $-PO_3M_2$ or $-PO_2M_2$ (M is a hydrogen atom or an alkali metal atom) or a reactive group which can be converted into said group such as $-SO_2F$, —COF, —CN; —COOR, $-PO_3R$ or $-PO_3R_2$; R represents a $C_1$—$C_{20}$ alkyl group.

The typical examples of Y have the structures bonding A to a fluorocarbon group such as $$\left(CF_2\right)_x-A,\ -O\left(CF_2\right)_x-A,\ \left(O-CF_2-\underset{\underset{Z}{|}}{C}F\right)_y-A,$$

$$\left(O-CF_2-\underset{\underset{Z}{|}}{C}F\right)_x\left(O-CF_2-\underset{\underset{Rf}{|}}{C}F\right)_y-A \text{ and}$$

$$-O-CF_2\left(\underset{\underset{Z}{|}}{C}F-O-CF_2\right)_x\left(CF_2\right)_y\left(CF_2-O-\underset{\underset{Rf}{|}}{C}F\right)_z-A$$

x, y and z respectively represent an integer of 1 to 10; Z and Rf represent —F or a $C_1$—$C_{10}$ perfluoroalkyl group; and A is defined above.

When a fluorinated cation exchange membrane having a carboxylic acid group content of 0.5 to 4.0 meq/g. dry resin which is made of said copolymer is used, the desired object of the present invention is especially, satisfactorily attained.

When such membrane is used, a current efficiency can be higher than 90% even though a concentration of sodium hydroxide is more than 40%.

When the carboxylic acid group content is in a range of 0.7 to 2.0 meq/g. dry resin, the object of the present invention is especially attained in stable to give excellent durability and life.

In order to give such ion-exchange capacity, a ratio of the units (b) in the copolymer of the units (a) and the units (b) is preferably in a range of 1 to 40 mole % especially 3 to 20 mole %.

The ion-exchange resin membrane used for the present invention is preferably made of a non-crosslinked copolymer of a fluorinated olefin monomer and a monomer having carboxylic acid group or a functional group which can be converted into carboxylic acid group. A molecular weight of the copolymer is preferably in a range of about 100,000 to 2,000,000 especially 150,000 to 1,000,000.

In the preparation of such copolymer, one or more abovementioned monomers can be used with a third monomer so as to improve the membrane. For example, a flexibility of the membrane can be imparted by incorporating $CF_2{=}CFORf$ (Rf is a $C_1$-$C_{10}$ perfluoroalkyl group), or a mechanical strength of the membrane can be improved by crosslinking the copolymer with a divinyl monomer such as $CF_2{=}CF-CF{=}CF_2$ or $CF_2{=}CFO(CF_2)_{1\text{-}3}CF{=}CF_2$.

The copolymerization of the fluorinated olefin monomer and a monomer having carboxylic acid group or a functional group which is convertible into carboxylic acid group, can be carried out by a desired conventional process. The polymerization can be carried out if necessary, using a solvent such as halohydrocarbons by a catalytic polymerization, a thermal polymerization or a radiation-induced polymerization. A fabrication of the ion-exchange membrane from the resulting copolymer is not cricital, for example it can be known-methods such as a press-molding method, a roll-molding method, an extrusion-molding method, a solution spreading method, a dispersion molding method and a powder molding method.

The thickness of the membrane is preferably 20 to 500 microns especially 50 to 400 microns.

When the functional groups of the fluorinated cation exchange membrane are groups which can be converted to carboxylic acid groups, the functional groups can be converted to carboxylic acid groups (COOM) by suitable treatment depending upon the functional groups before the membrane being used in electrolysis, preferably after the fabrication.

When the functional groups are —CN, —COF, —COOR, —$SO_2F$, (R is defined above), the functional groups can be converted to carboxylic acid groups (COOM) or sulfonic acid groups by hydrolysis or neutralization with an acid or an alcoholic aqueous solution of a base.

When the functional group is double bonds, they are converted into carboxylic acid groups by reacting them with $COF_2$.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

In accordance with the production of an alkali metal hydroxide by an electrolysis of an aqueous solution of an alkali metal chloride, an aqueous solution of an alkali metal chloride is fed into an anode compartment and water is fed into a cathode compartment which are partitioned with the cation-exchange membrane to perform the electrolysis.

The alkali metal chloride used in the process of the present invention is usually sodium chloride and can be also another alkali metal chloride such as potassium chloride and lithium chloride. The corresponding alkali metal hydroxide can be advantageously produced from the aqueous solution for a long period in stable condition and high efficiency.

In accordance with the process of the present invention especially a production of sodium hydroxide from sodium chloride, at 50° to 100° C. and a current density of 20 to 100 A/dm$^2$ to obtain about 20 to 40% of sodium hydroxide at a current efficiency of higher than 90%, the cell voltage can be lower for about 0.5 to 0.2 V than that of the conventional process.

The present invention will be further illustrated by certain examples and references which are provided for purposes of illustration only and are not intended to be limiting the present invention.

EXAMPLE 1

1000 Milligrams of nickel powder obtained by thermally decomposing nickel formate having particle sizes of less than 25$\mu$ at 230° C. in argon flow for 20 minutes and 50 mg of polytetrafluoroethylene having a particle diameter of less than 1$\mu$, were dispersed in 100 cc of water with a drop of a nonionic surfactant (Trademark Triton X-100) in a beaker and the mixture was stirred under an ultrasonification to obtain a suspension. The suspension was filtered to form a sheet having 100 cm$^2$ on a porous filter made of polytetrafluoroethylene. The sheet had an average pore size of 5$\mu$; a porosity of 75% and an air permeable coefficient of $1\times10^{-3}$ mole/cm$^2$.min.cmHg. This was used as a cathode.

On the other hand, 1000 mg of platinum black powder and 50 mg of polytetrafluoroethylene were treated by the same manner to obtain a sheet having an area of 100 cm$^2$ which had an average pore size of 5$\mu$; a porosity of 85% and an air permeable coefficient of $1\times10^{-3}$ mole/cm$^2$.min.cmHg. This was used as an anode.

An ion-exchange membrane made of a copolymer of tetrafluoroethylene and $CF_2{=}CFO(CF_2)_3(COOCH_3$ having a thickness of 250$\mu$ and an ion-exchange capacity of 1.45 meq/g.dry resin was used and said cathode with the filter and said anode with the filter were placed on the different surface of said membrane and press-bonded at 150° C. under a pressure of 20 kg/cm$^2$. The polytetrafluoroethylene filters on each of the cathode and the anode were peeled off and the product was dipped in 25 wt.% aqueous solution of sodium hydroxide at 90° C. for 16 hours thereby hydrolyzing said ion-exchange membrane. Each platinum gauze as a current collector was brought into contact with each of the cathode and the anode to form an electrolytic cell. 5N-NaCl aqueous solution was fed into an anode compartment whereas water was fed into a cathode compartment and an electrolysis was carried out under maintaining a concentration of sodium hydroxide of 35 wt. % in the catholyte. The results are as follows.

| Current density (A/dm$^2$) | Cell voltage (V) |
|---|---|
| 10 | 2.74 |
| 20 | 2.94 |
| 30 | 3.14 |

A current efficiency in the production of sodium hydroxide in a current density of 20 A/dm$^2$ was 94%.

EXAMPLE 2

In accordance with the process of Example 1 except using 1000 mg of a commercial stabilized Raney nickel powder having a particle diameter of less than 44$\mu$ to prepare a cathode and pressbonding it on the same ion-exchange membrane, sodium hydroxide was produced from the aqueous solution of sodium chloride by using the electrolytic cell. The results are as follows.

The cathode had an average pore size of 6$\mu$; a porosity of 78% and an air permeable coefficient of $1\times10^{-3}$ mole/cm$^2$.min.cmHg.

| Current density (A/dm$^2$) | Cell voltage (V) |
|---|---|
| 10 | 2.75 |
| 20 | 2.96 |
| 30 | 3.17 |

A current efficiency in the production of sodium hydroxide was 93% in a current density of 20 A/dm$^2$.

EXAMPLE 3

In accordance with the process of Example 1 except using 2000 mg of Raney nickel alloy powder having a particle diameter of 44$\mu$ to prepare an electrode and press-bonding it on the same ion-exchange membrane, and then dissolving aluminum component from the alloy with an aqueous solution of sodium hydroxide, sodium hydroxide was produced from the aqueous solution of sodium chloride by using the electrolytic cell. The results are as follows.

The cathode had an average pore size of 4$\mu$; a porosity of 80%, and an air permeable coefficient of $2\times10^{-3}$ mole/cm$^2$.min.cmHg.

| Current density ($A/dm^2$) | Cell voltage (V) |
|---|---|
| 10 | 2.75 |
| 20 | 2.95 |
| 30 | 3.16 |

A current efficiency in the production of sodium hydroxide was 94% in a current density of 20 $A/dm^2$.

EXAMPLE 4

In accordance with the process of Example 1 except using 1000 mg of a commercial carbonyl nickel poweder having a particle diameter of 5 to 6$\mu$ to prepare a cathode and press-bonding it on the same ion-exchange membrane, sodium hydroxide was produced from the aqueous solution of sodium chloride by using the electrolytic cell. The results are as follows.

The cathode had an average pore size of 3$\mu$; a porosity of 70% and an air permeable coefficient of $8\times10^{-4}$ mole/$cm^2$.min.cmHg.

| Current density ($A/dm^2$) | Cell voltage (V) |
|---|---|
| 10 | 2.76 |
| 20 | 2.97 |
| 30 | 3.19 |

A current efficiency in the production of sodium hydroxide was 93% in a current density of 20 $A/dm^2$.

EXAMPLE 5

10 Grams of a stabilized nickel powder, 1 g. of polytetrafluoroethylene having a particle diameter of less than 1$\mu$, 0.3 g. of methyl cellulose, 10 ml. of water and 10 ml. of isopropyl alcohol were thoroughly mixed. The mixture was screen-printed on one surface of the ion-exchange membrane of Example 1 by using a screen having a mesh number of 200, a thickness of 30$\mu$ and an emulsifier thickness of 30$\mu$ to obtain cathode layer having a thickness of 35$\mu$ and containing stabilized Raney nickel of 7 mg./$cm^2$.

In accordance with the process of Example 1, the anode was bonded to the cathode at 150° C. under a pressure of 20 kg./$cm^2$ and hydrolyzed it and the electrolytic cell was prepared.

In accordance with the process of Example 1, an electrolysis of 5N-NaCl. aqueous solution was carried out. The results are as follows.

| Current density ($A/dm^2$) | Cell voltage (V) |
|---|---|
| 10 | 2.80 |
| 20 | 3.02 |
| 30 | 3.22 |

A current efficiency in the production of sodium hydroxide in a current density of 20 $A/dm^2$ was 93%.

We claim:

1. In a process for producing an alkali metal hydroxide by electrolyzing an aqueous solution of an alkali metal chloride by using a gas and liquid-permeable cathode bonded on an ion-exchange membrane, the improvement wherein said gas and liquid permeable cathode consists essentially of a nickel containing powder selected from the group consisting of a thermally decomposed nickel obtained from a nickel salt of fatty acid; Raney nickel; stabilized Raney nickel; and carbonyl nickel and a polytetrafluoroethylene.

2. A process according to claim 1 wherein said nickel salt of fatty acid is nickel formate, nickel acetate, nickel oxalate, nickel stearate or nickel citrate.

3. A process according to claim 1 wherein the ratio of said nickel containing powder to said polytetrafluoroethylene is in the range of 10:0.05 to 5 by weight.

4. A process according to claim 1 wherein said gas-liquid permeable cathode has an average pore size of 0.01 to 1000$\mu$ and a porosity of 20 to 95%.

5. A process according to claim 1 wherein said ion-exchange membrane is a fluorinated cation exchange membrane.

6. A process according to claim 1 wherein the ratio of said nickel containing powder to said polytetrafluoroethylene is in the range of 10:0.05 to 5 by weight, wherein said gas-liquid permeable cathode has an average pore size of 0.01 to 1000$\mu$ and a porosity of 20 to 95%, and wherein said ion-exchange membrane a fluorinated cation exchange membrane.

7. A process according to claim 6 wherein said nickel containing powder and said polytetrafluoroethylene are combined by admixing the powder with an aqueous dispersion of polytetrafluoroethylene and thereafter removing water.

* * * * *